US006803728B2

(12) United States Patent
Balasubramaniam et al.

(10) Patent No.: US 6,803,728 B2
(45) Date of Patent: Oct. 12, 2004

(54) SYSTEM FOR CONTROL OF DEVICES

(75) Inventors: Gnanagiri Balasubramaniam, Briarcliff Manor, NY (US); Richard Leo Black, Gilbertsville, PA (US); Brian Michael Courtney, Warminster, PA (US); Jason Douglass Craze, Allentown, PA (US); Stuart William Dejonge, Riegelsville, PA (US); William Harlan Howe, Palm, PA (US); Benjamin Aaron Johnson, Quakertown, PA (US); Glen Andrew Kruse, Lansdale, PA (US); Donald Ray Mosebrook, Coopersburg, PA (US); Daniel Curtis Raneri, Easton, PA (US); Chris Mark Rogan, Pleasant Gap, PA (US); Timothy Russell Roper, Pen Argyl, PA (US); Siddarth P. Sinha, Fontainbleau (FR); Steven Spencer Thompson, Quakertown, PA (US); Brian Raymond Valenta, Emmaus, PA (US); Robert Francis Walko, Jr., Perkasie, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/244,954

(22) Filed: Sep. 16, 2002

(65) Prior Publication Data

US 2004/0051467 A1 Mar. 18, 2004

(51) Int. Cl.[7] ..... H05B 37/02; H05B 39/04

(52) U.S. Cl. ..... 315/149; 315/294; 362/85

(58) Field of Search ..... 315/149, 294, 315/155, 292, 299, 315, 320, 317, 319, 316, 360; 362/233, 85, 293, 234, 339

(56) References Cited

U.S. PATENT DOCUMENTS

| | | | | | |
|---|---|---|---|---|---|
| 4,980,806 | A | * | 12/1990 | Taylor et al. | 362/85 |
| 5,406,176 | A | * | 4/1995 | Sugden | 315/292 |
| 5,736,965 | A | | 4/1998 | Mosebrook et al. | 343/702 |
| 5,838,226 | A | | 11/1998 | Houggy et al. | 340/310.01 |
| 5,848,054 | A | | 12/1998 | Mosebrook et al. | 370/226 |
| 5,905,442 | A | | 5/1999 | Mosebrook et al. | 340/825.06 |
| 5,982,103 | A | | 11/1999 | Mosebrook et al. | 315/149 |
| 6,605,907 | B2 | * | 8/2003 | Belliveau | 315/294 |
| 6,687,487 | B1 | | 2/2004 | Mosebrook et al. | 455/11.1 |

* cited by examiner

*Primary Examiner*—Don Wong
*Assistant Examiner*—Chuc Tran
(74) *Attorney, Agent, or Firm*—Drinker Biddle & Reath LLP

(57) ABSTRACT

A wireless control system for lighting or the like has a central processor that receives commands from keypads and other control devices, and sends commands to dimmers and other controlled devices. The central processor also receives status reports from the dimmers and sends updates to the keypads, in order to ensure that displays on the keypads are up to date.

40 Claims, 10 Drawing Sheets

SYSTEM FOR CONTROL OF DEVICES

FIELD OF THE INVENTION

The invention relates to a system for control of devices, and especially to a system for wireless control of lighting.

BACKGROUND OF THE INVENTION

Systems for the control of lighting are known in which keypads, switches, or other controls, hereinbelow generally referred to as "event initiators" are operated by a user, the event initiators communicate to a central processor, and the central processor communicates to the various lighting control devices. One such system is the HomeWorks® Interactive™ lighting control system manufactured by Lutron Electronics Co., Inc. of Coopersburg, Pa., U.S.A. The HomeWorks® Interactive™ system is designed to operate primarily with hard-wired connections between the various components of the system.

Lighting control systems using radio communication between separated components are also known. One such system is the RadioRA™ lighting control system manufactured by Lutron Electronics Co., Inc. Wireless systems are quicker and easier to install and reconfigure than hard wired systems. However, the radio frequency power and bandwidth available are usually limited by both regulatory and practical considerations. The frequency spectrum available is also used by many other systems. For example, the U.S. Federal Communications Commission allows low power, intermittent transmissions over a wide range of frequencies, including not only this sort of wireless control system, but also security systems, garage door closers, and the like. However, a large percentage of the range of frequencies is used by licensed operators, allowing only a small percentage of the range for use by unlicensed operators. Domestic lighting control systems need to be able to operate unlicensed, and therefore in the small percentage of unlicensed operator space.

Within that small space, interference among operators further limits the range of available frequencies at any given location. Because of the possibility of interference, and the need to operate at low power levels, it is also highly desirable to assess the quality of radio communications between devices within a wireless lighting control system. A measure of the quality of radio frequency communications is the probability of receiving a valid signal. Methods of assessing radio communications quality include measuring bit error rate, measuring ambient noise levels, and measuring the received signal strength of an intended signal, among others.

It is therefore an object of the present invention to provide improved control systems, and methods of installing and operating such control systems, that are especially suited to the wireless control of lighting installations, and to provide lighting installations equipped with such control systems.

BRIEF DESCRIPTIONS OF THE INVENTION

In one aspect, the invention provides a method of remote control of devices, comprising: detecting operation of at least one control by a user; predicting whether the event commanded by said operation of said at least one control will result in a change of state of a display; updating said display if the predicted state of said display differs from the state of said display before said operation of at least one control; transmitting a command indicative of said operation of said at least one control; receiving a response indicative of an event that actually occurred in response to said transmitted command; determining a correct state of said display; and updating said display if said correct state of said display differs from the state of said display as updated on the basis of said prediction.

In another aspect, the invention provides an event initiator that comprises:

at least one control operable by a user; a display; and a transmitter and receiver for sending commands and receiving responses; and wherein said event initiator is adapted to: detect operation of at least one control by a user; predict whether said operation of said at least one control will result in a change of state of said display; update said display if the predicted state of said display differs from the state of said display before said operation of at least one control; transmit a command indicative of said operation of said at least one control; receive a response indicative of an event that actually occurs in response to said transmitted command; and update said display if a state of said display correct in view of said response differs from the state of said display as updated on the basis of said prediction.

In another aspect, the invention provides an event initiator for a wireless lighting control system, comprising: at least one control operable by a user; a transmitter for sending commands to another unit within the system in response to operation of said at least one control; and a memory storing a control model that relates operations of said control to commands sent. The control model identifies operations of the control that denote valid commands, and associates a transmissible command with each identified operation.

In another aspect, the invention provides a lighting control system comprising at least event initiators having controls operable by a user and devices controlled by said event initiators, wherein: the event initiators and controlled devices comprise parts of a system database; the database part within each event initiator maps operations of controls by a user to commands transmissible from such event initiator to said controlled devices; the database part within each controlled device maps commands received from an event initiator to actions of such device; and the transmissible commands contain less data than is necessary to describe completely the operations of controls or the actions of devices.

An event initiator for a wireless lighting control system that comprises a plurality of sub-nets each operating on a different radio channel, the event initiator comprising: a database of said channels; and a transmitter and receiver capable of operating on any of said channels. The event initiator is arranged, upon activation, to search through channels in its database for an active sub-net of the system with which it can communicate.

In another aspect, the invention provides a method of assessing the quality of radio communications within a wireless lighting control system, the wireless lighting control system comprising a plurality of wireless transmitter/receivers, comprising the steps of: transmitting a signal from one wireless transmitter/receiver within the system; causing other wireless transmitter/receivers within the system to measure the strength of the signal they receive; and compiling a record of measured signal strengths.

In another aspect, the invention provides a method of selecting an operating channel for a radio frequency system, comprising the steps of: tentatively selecting a first channel; communicating on a second channel while determining whether the tentatively selected channel is suitable for communication; if the tentatively selected channel is found to be unsuitable, tentatively selecting a different channel, and repeating said steps of communicating, and determining; and when a tentatively selected channel is found to be suitable, starting to communicate on that channel as the operating channel.

In another aspect, the invention provides a method of selecting an operating channel for a radio frequency system, comprising the steps of: tentatively selecting a first channel; communicating on said tentatively selected first channel, while determining whether said tentatively selected first channel is suitable for communication; if said tentatively selected first channel is found to be unsuitable, tentatively selecting a different channel, and repeating said steps of communicating, and determining; and when a tentatively selected channel is found to be suitable, starting to communicate on that channel as the operating channel.

In another aspect, the invention provides a method of selecting an operating channel for a radio frequency system, comprising the steps of: providing a plurality of devices capable of communicating on a plurality of channels; tentatively selecting a first channel; causing the devices to communicate on a second channel; on the second channel, announcing the tentatively selected channel to the devices; switching the devices to the announced channel; by the devices, detecting properties of the tentatively selected channel; reporting back the results of such detection from the devices on the second channel; from such results, determining whether the tentatively selected channel is suitable for communication; if the tentatively selected channel is found to be unsuitable, tentatively selecting a different channel, and repeating said steps of announcing, switching, detecting, reporting, and determining; and when a tentatively selected channel is found to be suitable, starting to communicate on that channel as the operating channel.

In another aspect, the invention provides a method of assessing the quality of an operating channel for a wireless lighting control system that has a plurality of transmitting and receiving devices, comprising the steps of: by the devices, detecting properties of the selected channel including at least one property selected from: an ambient noise level on the selected channel at the location of each device; and the presence or absence of a contending system using the same channel within radio range of any device; and determining from the detected properties whether the channel is suitable for communication.

In another aspect, the invention provides a method of operating a wireless lighting control system, comprising the steps of: receiving at an event initiator a command from a user; transmitting over a wireless link a command corresponding to the command; receiving a transmitted command at a lighting device controller; and altering the state of a lighting device, by the controller, within 300 ms after the command is received at the event initiator.

A method of operating a wireless lighting control system, comprising the steps of: receiving at an event initiator a command from a user; transmitting over a wireless link a command corresponding to the command; receiving a transmitted command at a lighting device controller; altering the state of a lighting device, by the controller; and displaying at the event initiator, within 1.5 s after the command is received at the event initiator, an indication of the state of said lighting device after said altering step.

In another aspect, the invention provides a method of operating a wireless lighting control system that comprises a central controller and a plurality of remote devices that are in communication over a wireless link with said central controller and are programmed with an operating system, the method comprising: uploading an operating system to said remote devices by wireless communication.

DETAILED DESCRIPTION OF THE DRAWINGS

Figure 1:
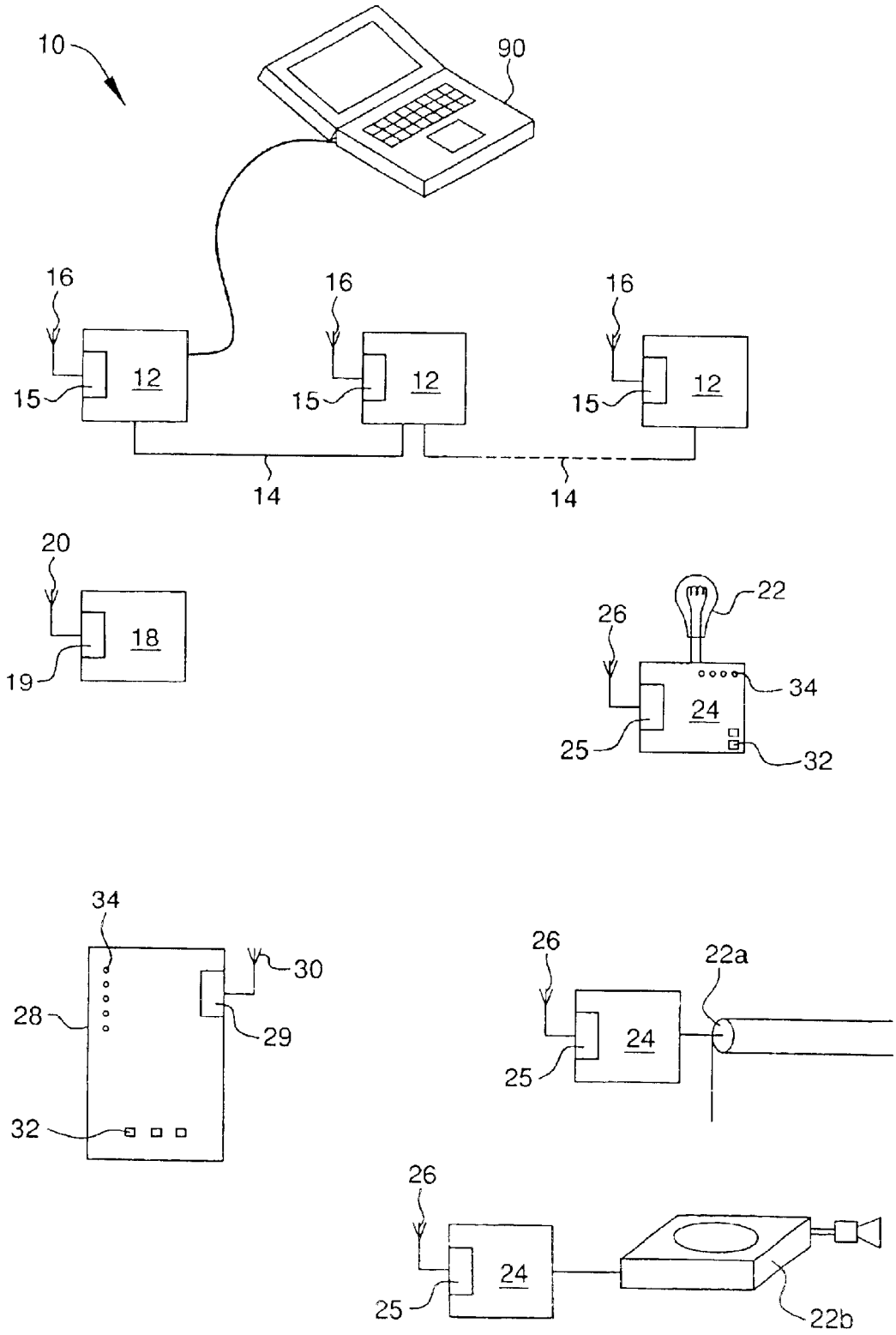
FIG. 1 is a schematic view of a wireless control system.

Referring to the drawings, and initially to FIG. 1, one form of lighting control system in accordance with the invention is indicated generally by the reference numeral 10. The system comprises central processors 12, which are linked together by communications wiring 14. (A wireless link may be used instead.) Each central processor 12 has a wireless transmitter/receiver 15 with an antenna 16. The wireless transmitters/receivers 15 are preferably radio transmitters/receivers operating on a frequency approved for the operation of devices of this sort by the regulatory authorities of the place where the system 10 is to be operated. Preferably, each transmitter/receiver is capable of being tuned to any of a block of frequency channels, and each central processor 12 operates on a different channel. In the U.S.A., 60 channels, each 100 kHz wide, are available.

The system 10 further comprises repeaters 18, each of which is equipped with a transmitter/receiver 19 with an antenna 20. In a manner that will be explained below, each repeater 18 is tuned to the channel used by a central processor 12 with which that repeater is associated. In normal operation, the repeaters 18 merely receive and retransmit signals, extending the effective range of communication from a central processor 12 beyond the reach of its own transmitter/receiver 15. Where appropriate, one repeater 18 may be in communication with another repeater 18, providing a still greater extension of range.

The system further comprises lamps 22, controlled by device controllers 24, each of which has a wireless transmitter/receiver 25 with an antenna 26. The system may also comprise devices other than lamps, for example, power operated window blinds 22*a*, a sound system 22*b*, or the like. Instead of, or in addition to, controlling lights, the system may be another system, such as a home automation or security system. In a manner that will be explained below, each device controller 24 is tuned to the channel used by a central processor 12 with which that device is associated. Each device controller 24 may be in radio communication with the central processor 12 directly, or via a repeater 18 or a chain of repeaters. Each device controller 24 receives commands from its central processor 12 for the operation of its lamp 22, and sends back to the central processor information on the actual operation of the controller and the controlled device.

The system further comprises keypads, switches, or other event initiators 28, each of which comprises a wireless transmitter/receiver 29 with an antenna 30 and at least one control 32 that can be operated by a user of the system. Each event initiator 28 preferably also comprises a display 34, which may be one or more light emitting diodes, a liquid crystal display, or any other suitable display. The display 34 may be visible or audible, or may work by touch, or even smell. In a manner that will be explained below, each event initiator 28 is tuned to the channel used by a central processor 12 with which that device is associated. Each event initiator 28 sends to its associated central processor 12, either directly or via one or more repeaters 18, user commands for the control of lamps 22 or other devices 22*a*, 22*b*, and receives from the central processor, and displays on the display 34, information about the actual status of the controlled devices.

Although in the interests of simplicity the device controllers 24 are described as separate from the event initiators 28 and displays 34, a device controller may also include a display 34, showing the status either of its own device 22 or of other devices, and or an event initiating control 32 either for its own device 22 or for other devices.

Each component of the system may be provided with electrical power from ordinary electrical outlets or wiring at its location, independently of any other device. Because the electrical wiring is not being used as a communication path, but merely as a source of power, there is no need to consider whether or not the different components are on power supply circuits that are isolated from one another. Except in the case of wired links 14 between different processors 12, the use of wireless communications also removes the need to prevent antenna loops from being formed between the power and data circuits between two components.

It will be appreciated that the number of each component, and the kinds of event initiator 28 and controlled device 22, 22*a*, 22*b* will vary, depending on the configuration of the individual system. In particular, a small system may have only a single central processor 12 and no repeaters 18. A system that has both a large number of controlled devices and a large spatial extent may have several central processors 12 and numerous repeaters 18. Provided that each central processor 12 operates on a different radio channel, they do not need to be spatially separate, but can control different aspects of the function of the system in a single area.

Figure 2:
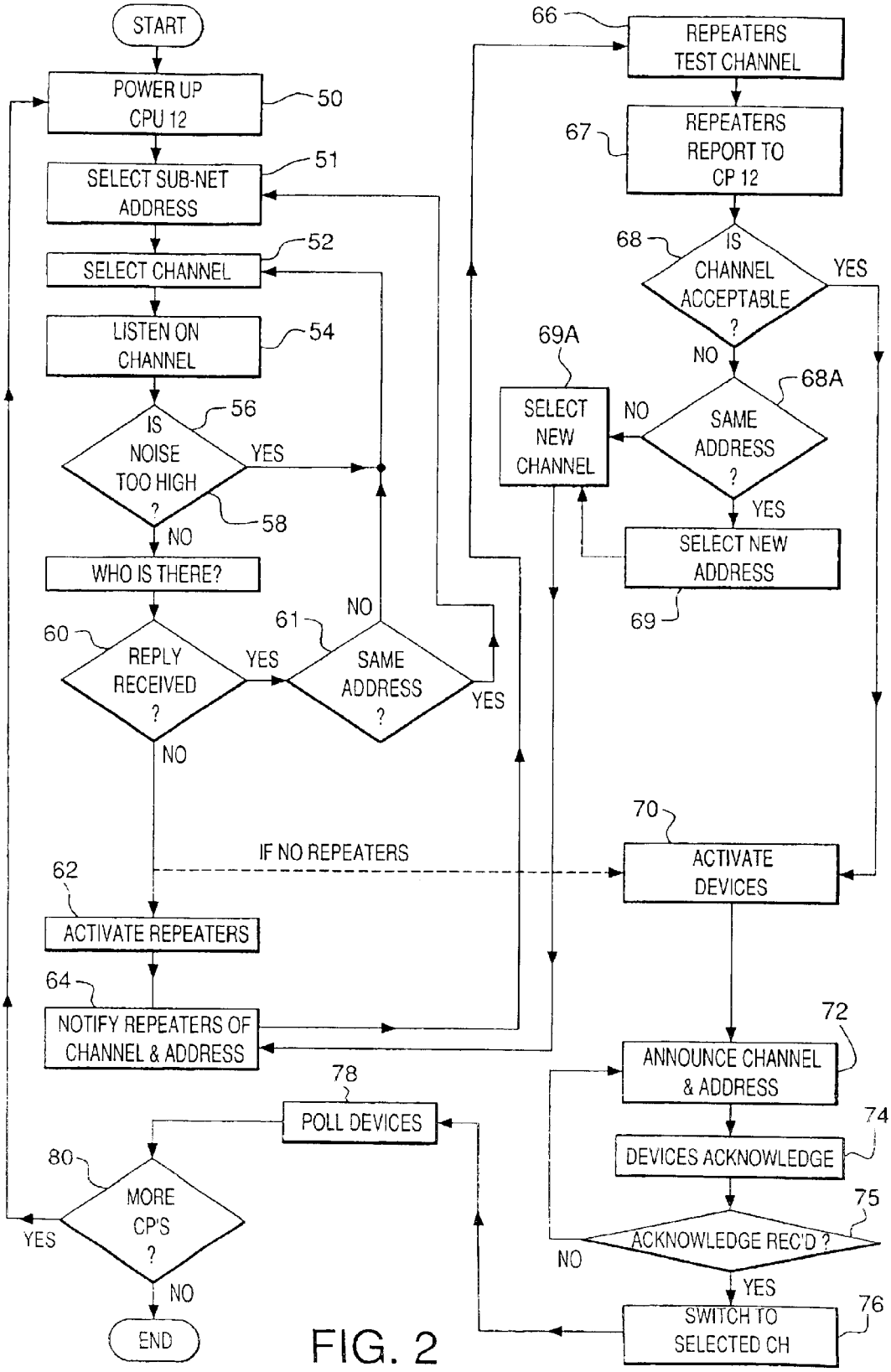
FIGS. 2 to 7 are flowcharts illustrating the setup, testing, and operation of the control system of FIG. 1.

Referring now to FIG. 2, when the system is initially installed, at step 50 a central processor 12 is first installed and powered up. At step 51, the central processor 12 selects at random a sub-net address. The sub-net address is an identifying code that will form part of every transmission by that central processor 12 or by any of the repeaters 18, device controllers 24, or event initiators 28 that are in wireless communication with that central processor, either directly or through one or more repeaters. The use of a sub-net address greatly reduces the risk of a transmission from outside the system being erroneously accepted as a message by any component within the system.

Next, the quality of radio communications within the wireless lighting control system is assessed. At step 52, the central processor 12 selects at random one of the available radio channels. At step 54, the central processor 12 listens to the selected channel, and at step 56 the central processor decides whether the ambient noise on that channel is unacceptably high. If the received signal strength is greater than a first threshold, the central processor rejects the channel as unusable, and returns to step 52 to select a different channel. If the received signal strength is less than the first threshold but greater than a second, lower threshold, the central processor 12 rejects the channel as usable but unsatisfactory, and returns to step 52 to select a different channel. The central processor maintains a list of rejected channels, to ensure that it does not inadvertently select a channel that has been selected and rejected in a previous iteration.

If the received signal strength is less than the second threshold, the central processor proceeds to step 58, and broadcasts on the selected channel a "who is there" message. Every central processor 12 in accordance with this embodiment is programmed to respond to such a message by transmitting a response including its sub-net address. This test thus reveals the presence of another similar, contending control system operating on the same channel within the range of the transmitter/receiver 15. At step 60, the central processor 12 checks whether a response has been received and, if it has, rejects the channel as unusable and rejects every sub-net address given by a contending system. At step 61, the central processor 12 checks whether the sub-net address actually being used by the central processor is the same as a rejected sub-net address. If so, the central processor returns to step 51 and selects a new sub-net address. Whether or not a new sub-net address has been chosen, if a response was received from a contending system, the central processor then goes to step 52 to select a new channel.

If no contending system is detected, the channel in question is tentatively selected, and at step 62 any repeaters 18 in the system are installed and activated. If there are no repeaters, the tentatively selected channel is selected, and the process jumps to step 70. At step 64, the central processor 12 informs the repeaters of the channel and sub-net address that have been tentatively selected. In a first embodiment, this is done using a "default" channel that is set into each unit when it is manufactured. This embodiment is the simplest to implement, but if the default channel is completely unusable then every unit must be manually reset to a different default channel, which is tedious for the installer. If a default channel is used, then the central processor is programmed not to select that channel for other purposes.

At step 66, each repeater 18 tests the tentatively selected channel for ambient signal strength and for responses to the "who is there" signal. Of course, at this stage, the central processor 12 and the repeaters 18 are programmed not to respond to each other's "who is there" signals. After a preset delay, for example, 10 seconds, at step 67 all units switch back to the default channel, and the repeaters 18 report back to the central processor 12 the ambient signal strength and the presence and sub-net address of any contending system. This step extends the test range of the system to detect sources of ambient interference or contending systems that are within range of the outermost repeaters 18, but are not within range of the central processor 12.

At step 68, the central processor 12 decides whether to accept or reject the channel, using the same criteria as in steps 54 to 60. If the channel is rejected, at step 68A, the processor checks whether a contending system with the same sub-net address has been detected and, if so, a new sub-net address is chosen at step 69. If the channel is rejected, the central processor tentatively chooses a new channel at step 69A, and returns step 64. It will be understood that in any subsequent iterations of steps 64–69A, the central processor 12 and the repeaters 18 will carry out the tests of steps 54 to 60 simultaneously.

It will be appreciated that, in the worst case, the above process may result in every channel being rejected. In that case, the system returns to step 64, and repeats the process using channels previously rejected as usable but unsatisfactory. Preference is given to channels with no contending system and a reasonably low ambient received signal strength. However, a contending system, especially one with a faint signal, can be tolerated as long as the two systems have different sub-net addresses.

Once a channel is selected in step 68, at step 70 the device controllers 24 and event initiators 28 are activated. In step 72, the central processor, on the default channel, announces the selected channel and the sub-net address. At step 74, each device acknowledges those instructions on the default channel. When the processor 12 confirms that every acknowledgement has been received, at step 76 every device switches to the selected channel. If the central processor fails to receive an acknowledgment from a specific unit 24 or 28, the processor may loop back to step 72, and make a further attempt to command that unit to switch. Instead, or in addition, the processor may proceed to step 78, in case the unit 24 or 28 did receive and act on the command to change channels, and only the acknowledgment was lost.

As a confirmatory measure, at step 78 the central processor polls every device on the selected channel to confirm that it is in communication. If a device fails to respond, this is probably best treated as a service fault to be diagnosed and remedied, rather than as part of the setup process. The central processor 12 therefore merely emits an error report to the installer, and does not itself take any remedial action.

At this stage, each unit needs to be assigned a unique address within the system, or at least within the sub-net, that can be used to address commands to that unit. It would be possible to use absolutely unique addresses, built into each unit at the factory. However, to reduce the length of the addresses, and thus the amount of network traffic, it may be preferred to assign to each unit a short address that is unique only within the system. Every subsequent signal will then contain the sub-net address, the address of the initiating and/or destination unit, and the substantive content of the message.

At step 80, if there are more central processors 12, the next processor 12 is activated, and the setup process resumes from step 50. However, the new processor 12 is preferably provided with the lists of unusable and unsatisfactory channels and sub-net addresses compiled by the previous processor, and initially avoids those selections. The new processor 12 also avoids the channels and sub-net addresses already in use by sub-nets in the system.

Although the installation process has been described above as being carried out by the central processor 12, it involves considerable processing work that is not required during normal operation of the control system. It may therefore be preferred to conduct the installation process under the control of a program running on a personal computer 90 that is connected to the central processor 12 for the duration of the installation process. This has the additional advantage that substantial databases, for example of the characteristics of the various types of component that can be included in the system, can be made available to the installer, and that data files created during the installation, for example, of the results of the channel and address selection routines described above, and the configuration of the system as installed, can be stored as ordinary computer-readable data files for future reference. Such stored data files are a useful starting point if an additional sub-net is added to the system at a later date, or if the system has to be reinitialized because of a contending system or source of ambient noise that was not discovered, or was not present, at the time of the original installation.

In a second embodiment, rather than the repeaters 18, event initiators 28, and device controllers 28 having a factory-defined default channel, when the repeaters 18, the event initiators 28, and the device controllers 24, are activated, they automatically scan the allowable channels for an activation signal that the central processor transmits on a tentatively selected channel, which it has selected using the same methodology as steps 52 through 60. The sub-net address is selected in a similar manner to that as described in connection with the description of FIG. 2. In a third embodiment, which is a modification of the first embodiment, preferably the central processor 12 tentatively selects two channels, and the activation signal informs the repeaters 18 of what the second channel is. One of the two channels is then used as the "default" channel and the other as the "tentatively selected" channel.

Figure 3:
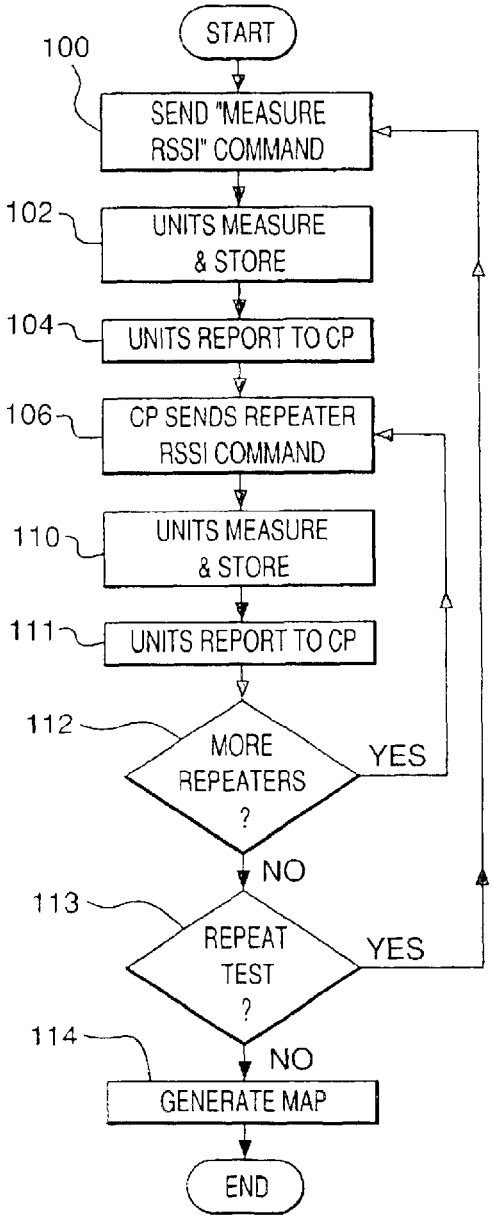

Referring now to FIG. 3, once the initial installation is complete, or as part of a later diagnostic test, the installer may wish to assess the quality of radio communications by surveying the signal strength of the various communications links in the system. The survey may cover any one or more of the classes of links: from a central processor 12 to its repeaters 18; from the repeaters 18 to the central processor; from one repeater to another; from the central processor and/or repeaters to the event initiators 28 and device controllers 24; from the event initiators and device controllers to the central processor and/or repeaters; or from the central processor to the event initiators and device controllers or vice versa, treating the repeaters transparently. The first four of those categories test the reliability of individual wireless links, while the last may reveal problems in the operation of a repeater. It is preferred to survey each wireless link separately in each direction, because the results may be different, especially where a problem is caused by an obstruction or a source of ambient noise close to one end of the link.

By way of example, FIG. 3 shows a method for generating a received signal strength indication (RSSI) Map for signals received by the controlled devices 24 and event initiators 28 from the central processor 12 and repeaters 18.

In step 100, the central processor 12 sends a "Measure RSSI and report back" command. This command consists of the actual command, followed by a standard signal that the receiving units can easily measure the signal strength of. The repeaters 18 relay the actual command to their units 24 and 28, but do not transmit the standard signal. In step 102, each unit receiving this command measures and stores the RSSI of the standard signal sent out in Step 100. Thus, each unit is measuring the signal received directly from the central processor's transmitter 15.

In step 104, each unit that received the command acknowledges and reports the RSSI value that it measured in step 102. The central processor 12, or the attached computer 90, records these results. A value of 0 may be entered if no reply is received from a particular unit. A 0 value is not necessarily a problem, because a unit that does not receive signals directly from the central processor 12 may later be found to receive a strong signal from one or more repeaters.

In step 106, the central processor 12 sends a command to "Measure RSSI values from Repeater 1". At step 110, every repeater 18, device controller 24, or event initiator 28 receiving the signal from repeater 1 records its strength, and at step 111 all of those units report back the RSSI value to the central processor 12. Provided that signals transmitted by repeaters 18 include a header identifying the repeater that sent the signal, all repeaters may be allowed to repeat the whole RSSI command as if it were a normal operating signal. Each receiving unit then receives the standard signal sent out from every repeater that it can hear, but responds by recording the strength only of the signal received directly from the specified repeater.

To assist the person conducting the test, where a unit measuring the RSSI value has a suitable display, it may provide an immediate local readout of the RSSI value. For example, a keypad 28 with an LED may cause the LED to flash at a rate indicative of the RSSI value.

In step 112, the central processor checks whether there are more repeaters to test. If so, the process loops back to step 106, and the central processor sends a command to measure RSSI values from the next repeater.

Once all of the repeaters 18 have been tested, in step 113 the central processor 12 decides whether to repeat the tests. For a quick assessment of the state of the system, a single series of tests, or an average of two measurements, may be sufficient. For a more precise result, the central processor may return to step 100 and repeat the process two or more times. Once the testing is completed, at step 114 the central processor generates a map or record of signal strengths. This may be a list of links or logical map in tabular form or, if the attached computer has a graphical user interface and a physical map of the system configuration, may display the physical location of strong and weak links. RSSI values greater than a pre-determined threshold may be considered good, implying the path loss from the central processor 12 or nearest repeater 18 to a particular unit is low enough for the link to be considered reliable, not marginal. If the results are based on more than one iteration of steps 100 to 112, the results presented may be a simple average of the measured results, or may also indicate the degree of variation between different iterations.

The central processor may generate a report to the installer listing all reliable links and/or all unreliable links after comparing all RSSI's to a predetermined threshold, or it may give the actual RSSI values and let the installer decide what is acceptable. This report gives the installer practical information regarding repeater placement in a system of devices, repeaters, and central processors. Potential weak links can be identified. For example, a device 24 or 28 may have no, or only one, reliable link to a repeater 18 and, if so, the installer may wish to add a repeater or move an existing repeater. The installer can set his own standards for the number of reliable links.

The Map generated by the process of steps 100 to 114 gives RSSI values based on the one way path loss from the central processor 12 and the repeaters 18 to the devices 24 and 28. RSSI values to obtain path loss values in the other direction (from the devices to the repeaters and central processor) can be generated using a similar method, by sending out a command that directs each device to transmit the standard signal, and measuring the RSSI of that signal at the central processor and at each repeater. The results for each device 24 or 28 may be measured and reported back to the central processor 12 separately or, if the repeaters have sufficient local memory, the system may test every device in a continuous sequence, and each repeater may then report back to the central processor a single list of results.

RSSI values between other pairs of system components, in either or both directions, can be generated analogously.

Figure 4:
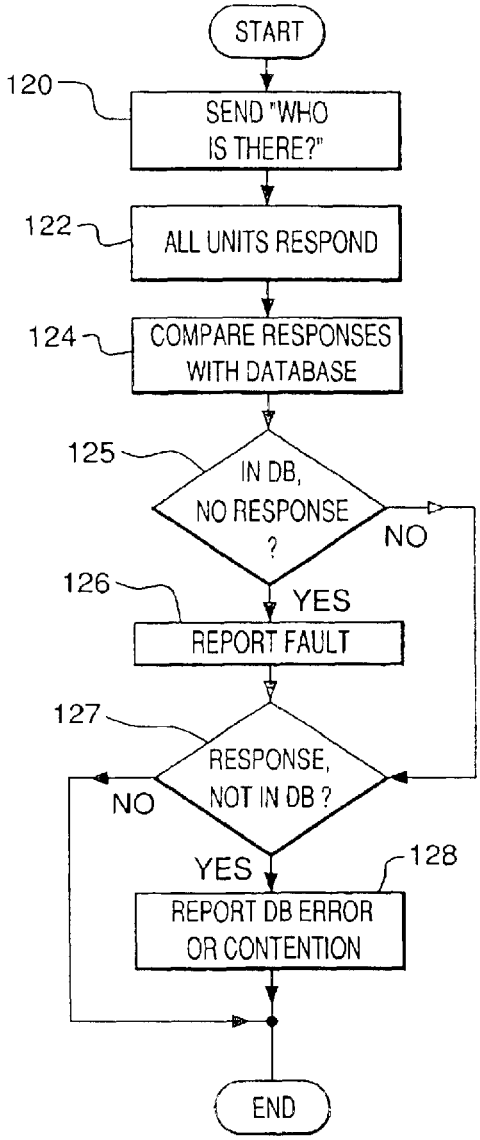

Referring to FIG. 4, as a further test of system integrity, in step 120 the central processor may broadcast a "who is there" message to which all units are programmed to respond in step 122. Each unit may identify itself either by including a unit address as part of its response, or by responding in a time slot that is determined by the unit address. In step 124, the central processor 12 then compares the responses with a database of the system, and reports to the user. Units that respond and are in the database do not suggest a problem. If in step 125 the processor 12 identifies units that are in the database but do not respond, then in step 126 the processor issues a report suggesting either a fault in the unit or a weak communication link. If in step 127 the processor 12 identifies units that respond but are not in the database, then in step 128 the processor issues a report suggesting either an error in the database or a contending system that was not detected in the installation process of FIG. 2.

Figure 5:
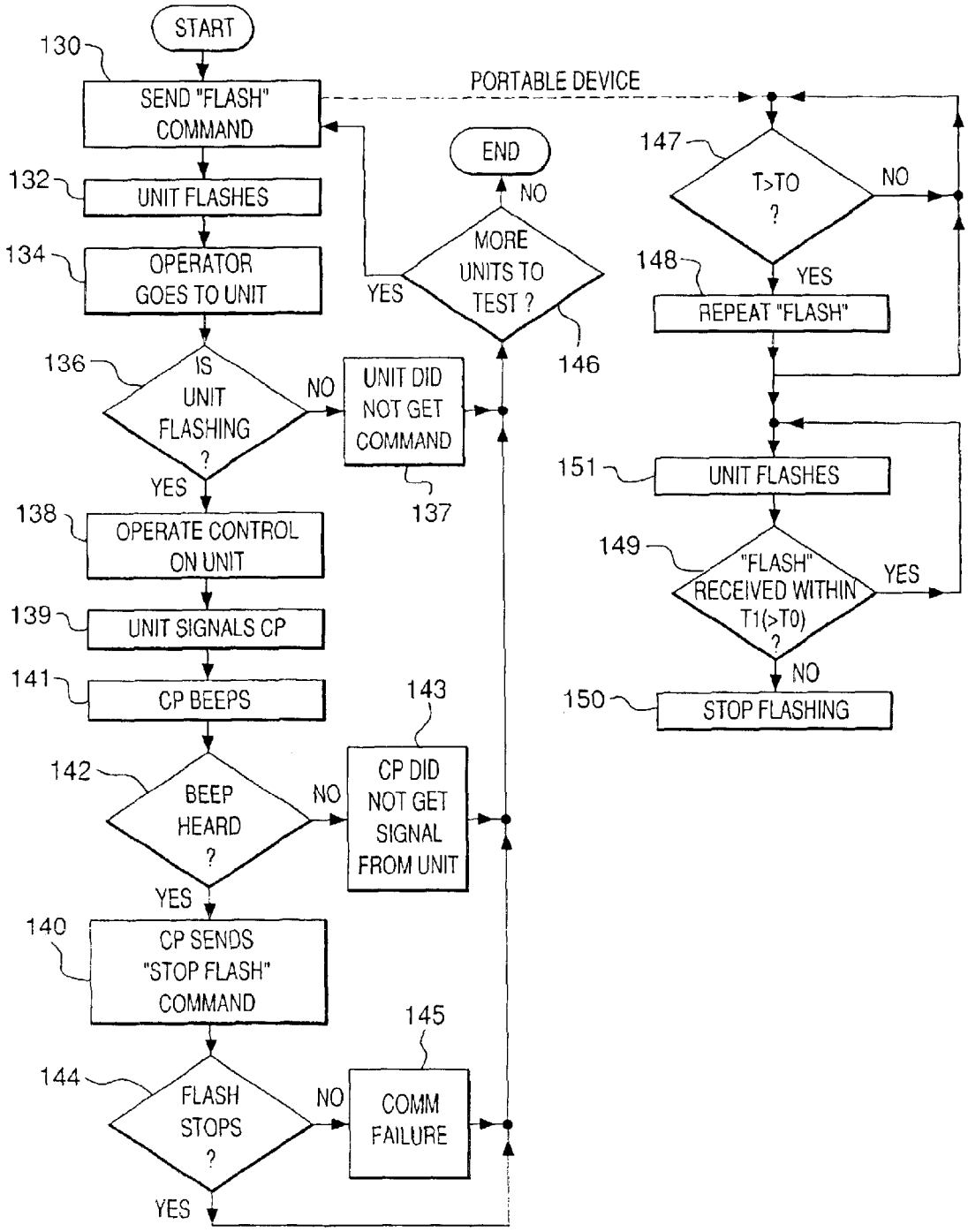

Referring to FIG. 5, as a further test of system integrity, in step 130 the central processor may issue a command to a particular device, or to all devices, to produce a distinctive indication. For example, in step 132 an event initiator 28 that has an LED indicator 34 may respond by flashing the LED continuously. For example, a lamp controller 24 may respond by flashing its lamp 22. Other types of unit may use other forms of indication. The indication merely needs to be distinctive and within the powers of the unit in question. In most cases, the indication is preferably reasonably conspicuous, but this may depend on circumstances. In step 134 an operator then goes to the device in question. In step 136, if it is not flashing, the operator deduces in step 137 that the device did not receive the "flash" command from the central processor. If the device is flashing, in step 138 the operator operates a control on the device. In step 139, the device 24 or 28 then signals the central processor 12, which replies in step 140 with an instruction to the device to stop flashing. The central processor 12 may also emit a signal, for example a loud beep, in step 141, when it receives the signal from the device. Thus, if in step 142 the operator does not hear the beep, the operator may infer in step 143 a failure in communication from the device to the central processor. If the operator hears the beep but the device does not stop flashing in step 144, the operator may infer in step 145 a failure in communication Once testing of the particular unit is completed, by failure in step 137, 143, or 145 or by success in step 144, the operator considers in step 146 whether there are more units to test. If so, the process returns to step 130, where the central processor either sends the "flash" command to the next unit, or maintains an "all units flash" command previously issued.

Instead of sending a single "flash" command that commands units to flash until the command is revoked, in steps 147 and 148 the central processor 12 may repeat the "flash" command to a device, at an interval T0, for example, every 5 seconds. In step 149 the device 28 then counts the time since the last "flash" command was received, and in step 150 the device stops flashing if no "flash" command is received within a preset period T1, which is longer than the time between commands sent in step 148. Thus, if the device 28 is moved outside the range of the nearest transmitter 15 or 19, it will stop flashing after the time period preset for step 149. If the device 28 is brought back into the range of a transmitter 15 or 19, it will start flashing again at step 151 when the next "flash" signal is received. This function is useful when, for example, repositioning repeaters. Both the range from the central processor 12 to the repeater 18 being moved and the range from the repeater to its client devices 24 and 28 can then be monitored. Where the device is, for example, a hand-held, battery powered event initiator 28, the device may be used as a simple signal-strength gauge to detect the boundaries of the area reached by the transmissions from the central processor.

The process of steps 147–151 may be used with any movable component of the system that is capable of producing a perceptible response to the "flash" command, but is most practical with hand-held, battery operated units that can be moved freely.

The "flash" command of steps 130 and 148, like the standard signal of the "measure RSSI" command in steps 100 and 108 of FIG. 3, may be emitted from the central processor 12 only, or from a specific repeater 18 only, if it is desired to examine the radio coverage of the specific transmitter, rather than that of the sub-net as a whole.

Figure 6:
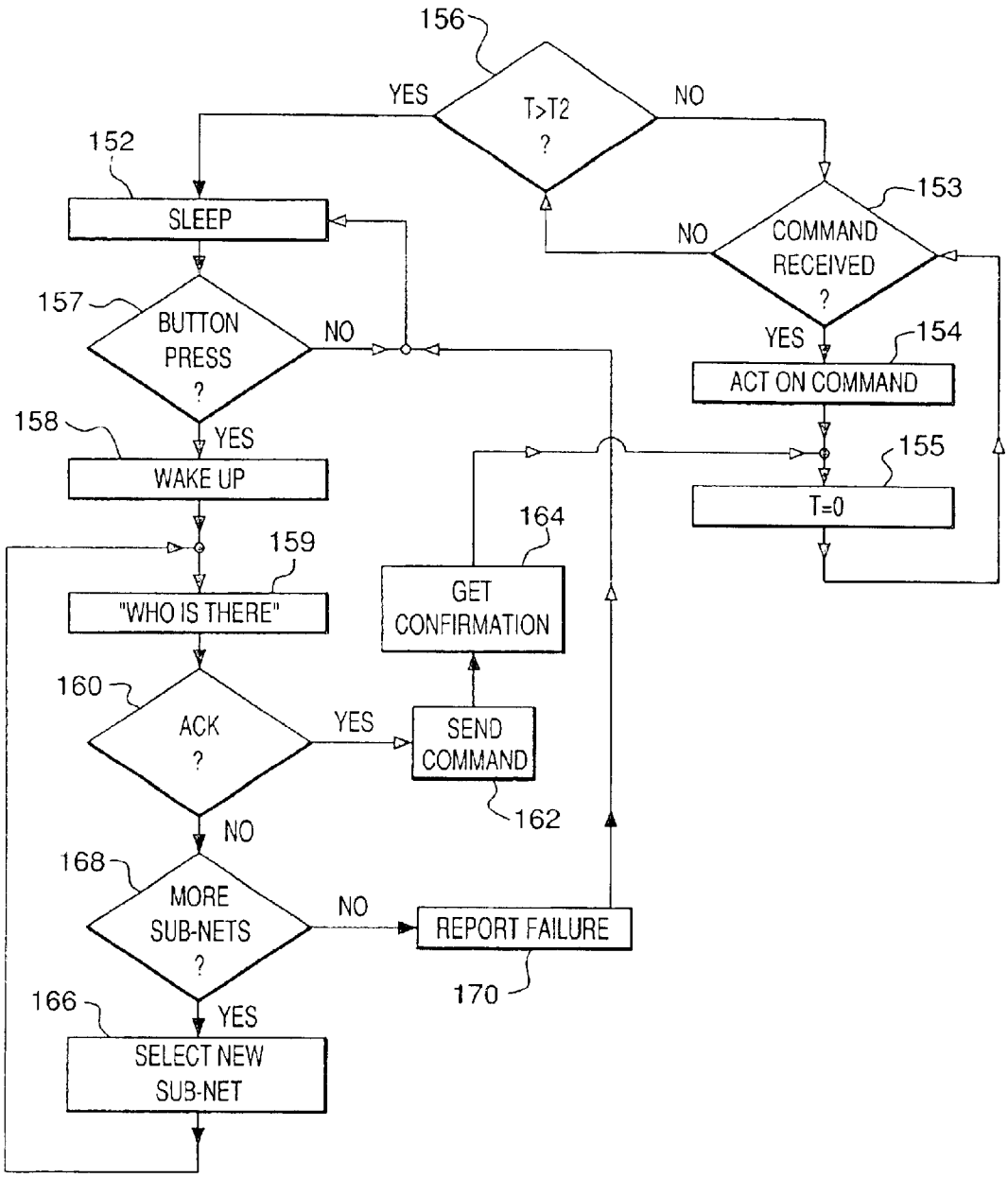

Referring to FIG. 6, portable devices, such as handheld event initiators 28, are preferably arranged to enter a "sleep" mode in step 152, in order to conserve battery power, when it is determined in steps 153 to 156 that the control has not received a command for a predetermined period T2. For the purpose of step 153, "command" includes both radio signals received from the central processor 12 or other units within the system, and button presses or other operations by a user of the handheld device 28. In the "sleep" mode, the device does not receive radio signals from the rest of the system. However, a handheld device may be moved while it is asleep. In particular, the device may be moved out of the range of the transmitter 15 or 19 with which it was previously in communication. Each handheld or otherwise reasonably portable device 24 or 28 is therefore programmed with a list of the radio channels and sub-net addresses for central processors 12 in the system to which it belongs. Where two or more sub-nets handle different functions in the same geographical region, duplicates may be omitted from the list.

When the handheld device 28 is operated in step 157, it "wakes up" in step 158. It then first sends out in step 159 a "who is there" signal addressed to the central processor 12 and repeaters 18 on the sub-net on which it was last active. If it receives an acknowledgement in step 160, it then transmits in step 162 a signal conveying the command corresponding to the user operation in step 157, waits for an acknowledgement in step 164, and returns to steps 153–156 to await further activity.

If in step 160 the handheld device 28 does not receive an acknowledgement, then it assumes that it is no longer in the area of the sub-net in question, and in step 166 the unit selects a different sub-net. Depending on how sophisticated the device 28 is, it may maintain a dynamic list of the most frequently or most recently used sub-nets, it may scan the allowed channels and start with the one having the strongest signals, or it may follow the order in which the channels are stored in its internal list. The unit then loops to step 159, and attempts to communicate on the newly-selected sub-net.

If in step 168 the device determines that it has tried every sub-net in its system without establishing communication, it assumes that it has been moved entirely outside its territory. In step 170, the device displays a failure signal, and then returns to step 152 and enters the "sleep" mode.

It will be appreciated that, where a portable event initiator 28 is moved around a large system its function may become ambiguous. For example, if the event initiator 28 controls a window blind 22*a*, it may always control the blinds on a specific window or group of windows. Instead, it may control the blinds on that window or group of windows if it is physically close to that window or group of windows, and otherwise do nothing. In either of those cases, the unit 28 is preferably conspicuously labeled to identify which windows it applies to. Instead, the event initiator may control the window blinds nearest to wherever it happens to be. This is only practical if each transmitter 15 or 19 covers a very small area, so that the physical location of the unit 28 can be determined precisely.

It has been found experimentally that, where an event initiator 28 has a display 34 offering feedback to the user on the effect of operating a control 32, the display 34 should preferably respond within approximately 0.5 and 1.5 seconds after the control is operated. If the response time is less than 0.5 seconds, the user will not notice any improvement in responsiveness. If the response time is greater than 1.5 seconds, the user stops paying attention and does not benefit from the feedback when it is displayed. With a wired system, it has been proposed for the display 34 simply to show the command that has been entered on the control 32, which can be done immediately, and to assume that is correct.

With a wireless system, on the other hand, there is a material risk that the command from the control 32 will not be correctly received and implemented by the device controller 24. It is therefore prudent for the event initiator 28 to display the actual status of the controlled device 22. However, confirmation of that status may not be available within 1.5 seconds after the control 32 is operated, especially if there is a long chain of repeaters involved, or if the level of radio traffic causes delay in transmitting messages. Therefore, the event initiator 28 maintains a memory of the status of the controlled device 22.

Figure 7:
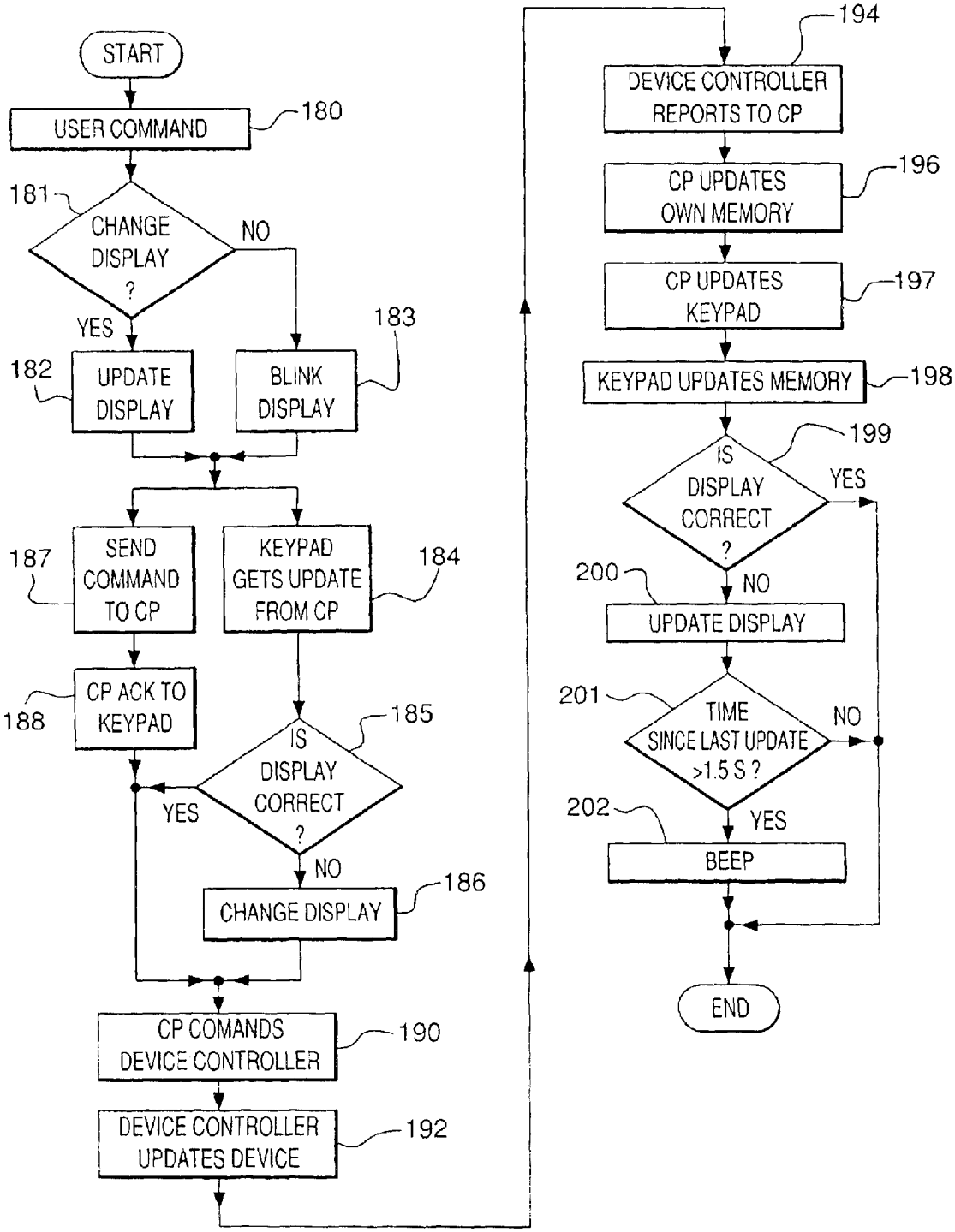

Referring to FIG. 7, if in step 180 the user operates the control 32, in step 181 the event initiator determines whether it is necessary to update the display 34. If so, at step 182 the event initiator may immediately update the display 34 to show the effect of the command just given by the user. If there is no change in the display because of step 182, then in step 183 a transient signal may be displayed to confirm that a button press has been registered. For example, the control 32 may be a button that cycles a lamp 22 through OFF and five different dimming levels, and the display 34 may be an LED that is lit unless the lamp 22 is OFF. Then, if the event initiator 22 believes it is merely changing the dimming level of the lamp 22, the LED 34 should stay on. In that case, the LED may be blinked off for a fraction of a second to show that a button press has been detected.

Instead of, or in addition to, step 182, in step 184 the event initiator 28 may immediately request from the central processor 12 current information on the status of the device 22. This status update may then be used in steps 185 and 186 to update the display 34. This is particularly important if the event initiator 28 is movable, has a sleep mode, or is otherwise not in continuous communication with the central processor 12. In those cases, the event initiator may be unaware of a change in the status of the controlled device 22 that was caused by another event initiator at a time when the first initiator was not receiving. It is also particularly important if the operation of the control 32 is ambiguous. For example, if pressing a button 32 toggles or cycles the status of the device 22, and the display 34, then the effect of pressing the button 32 will depend on the status of the device immediately before the button was pressed.

In step 187, the event initiator 28 transmits to the central processor 12 the command corresponding to the user's operation of the control 32. In step 188, the central processor 12 acknowledges the signal from the event initiator 28.

The status update process of steps 184–186 and the command and acknowledgment process of steps 187–188 are shown in parallel in FIG. 7, because either may come first. For example, if the event initiator 28 is portable, an update may be requested and obtained as part of the handshaking process in steps 159 and 160 of FIG. 6. Instead, the update may be part of the acknowledgment message in step 188, or an update may be separately requested and supplied at any convenient point.

In step 190, the central processor then commands the device controller 24 to change the status of the device 22. In step 192, the device controller 24 does so, and monitors the device 22 to ensure that it is working correctly in its new status. In step 194, the device controller 24 reports back to the central processor 12. In step 196, the central processor 12 updates its own record of the status of the device 22, and in step 197 the central processor signals the current status to the event initiator 28. Instead of one of the explicit update steps 184 and 197, the event initiator 28 may be programmed to recognize, and at least partly understand, one of the signals between the central processor and the device controller 24. In step 198, the event initiator 28 updates its own memory of the status of the device 22. In step 199, the event controller 28 checks whether the display 34 needs to be changed. If so, it updates the display 34 in step 200. If there is a change in the display 34, and it is determined in step 201 that there has been a significant delay since the display was last updated in step 182 or step 186, then in step 202 the event initiator may emit a beep or other attention-catching signal to alert the user to the change.

It will be understood that the event initiator 28 will usually have only a very oversimplified knowledge of the controlled device 22, and status information received by the event initiator from the processor will be similarly simplified. For example, if the control 32 is a button, and the display 34 is a row of LEDs, the event initiator may simply cycle through the row of LEDs, advancing one step every time the button 32 is pressed. Any status update from the central processor then merely needs to tell the event initiator 28 where in the cycle it should be.

Because the radio channels used by the present system have very limited bandwidth, and because an entire sub-net shares a single channel, so that it will often be impossible for two messages to be transmitted simultaneously without interfering with one another, it is important to minimize the amount of radio traffic. In particular, it is useful to minimize prolonged continuous transmissions that occupy the radio channel.

Therefore, each event initiator 28 contains a memory in which is stored a "control model" of the intended operations of that event initiator. A control model is defined as a description of the behavior of a control system, including the expected next state of the control system, and what values it should output, if any, depending upon the current state of the system, and the values of any received inputs. A "button model" is one type of a control model, found, in this instance, in event initiators, typically having user actuatable buttons. The button model contains information on the intended operation of the event initiator in response to actuation of the buttons thereon, and in response to receipt of information signals received thereby. Corresponding information is stored in the memory of the central processor 12. Thus, instead of transmitting a series of "button pressed" and "button released" signals, or continuous or rapidly repeated "button is down" signals, the event initiator can analyze the physical and logical operation of the button, and send more efficient signals.

If either a single or a double tap of the button is a valid command, if the button is pressed the event initiator may wait for a short period to see whether or not there is a second press, and then transmit either a "single tap" signal or a "double tap" signal. If a single tap is a valid command, but a double tap is not valid, the event initiator may transmit a "single tap" command as soon as the button is pressed and released once, and may ignore a second press immediately following.

It has been observed that if the light being controlled is visible to the user operating the control 32, the user may become impatient if no response is perceived within a period as short as 300 ms. This time is shorter than the minimum required time mentioned above for response by the display 34, because the user does not need to think consciously about the expected and actual results. This may present problems if, for example, the control 32 is a button that toggles a light on and off, and the impatient user presses the button again, thus reversing its toggle status. The user trying to turn the light on then turns it off again, or vice versa. If a control 32 is a toggle button, and the controlled device 22 is known to be slow to respond, the button model may transmit a first button press immediately, and ignore a second press of the button within the response period of the device 22.

A button may be intended to be pressed, starting a slow change, say in dimming of a lamp or in the position of a blind, and held until the change reaches the desired level. In that case, for long changes the efficient use of the radio channel is to send a "button pressed" signal and a "button released" signal. This leaves the radio channel free for other traffic while the button is being held down. However, for a very slight change it may not be possible to send the "button released" signal quickly enough. Therefore, the optimum model may be to send an initial "button is down" signal. Then, if the button is released, the signal ends immediately, and that trailing edge is the effective signal to stop the change. This gives a precise response: first, because the event initiator 28 is already in possession of the radio channel, and does not need to wait for another transaction to finish; and second, because it is not necessary to send a message header before the operative part of the signal.

If the button 32 is held for more than a certain period, the event initiator 28 sends a "button stays down" signal and releases the radio channel. When the button is eventually released, the event initiator sends a separate "button released" signal. On a long change, the delay that may be experienced in sending and receiving the separate "button released" signal, and any resulting overshoot in the level being changed, is much less noticeable. It is still preferred to achieve a consistent response time no slower than 300 ms, to give reasonably accurate control of the final level of the blind or light and, if more than one blind or light is involved, to ensure that they all stop at approximately the same level.

If the control 32 is a slider, it may be sufficient to wait until it stops moving, and then transmit a single signal giving its final position. However, it may be necessary to transmit a series of progress signals so that the controlled device 22 can track the slider as the slider is moved. It may be appropriate to use the single signal for a sudden movement, and the series of signals for a slow, prolonged movement. The choice of which mode to use will likely depend not only on what the controlled device is, but also on where the device is. A user who is within the field of a lamp being dimmed is more likely to expect to see the lamp brightness change in real time as the user moves the dimmer slider.

Different buttons 32 on a single event initiator 28 can be set up to have different effects on the same controlled device. For example, one button may be configured always to turn on the lights to 100% every time it is pressed, while another button may toggle the lights between 100% and off with each button press. Likewise, the LEDs can be used to give the user different types of feedback. For example, one LED might be on if and only if the lights are all on at 100%, while another LED may be on whenever any of the lights are on, no matter the level.

The button model is preferably stored in a field-programmable but non-volatile memory on the event initiator 28. This greatly simplifies manufacture and distribution, by allowing the installer to configure a standard event initiator to the requirements of a particular installation. Preferably, the memory is field-reprogrammable, to allow the event initiator to be reconfigured if the system is changed, or to be reassigned to a different function within the system.

The button configuration may allow a button to be configured at run-time by a user, giving the users flexibility in their programming and system layout, or may require special equipment and/or knowledge so that the system can be reconfigured only by a "super user" or a maintenance engineer.

Figure 8:
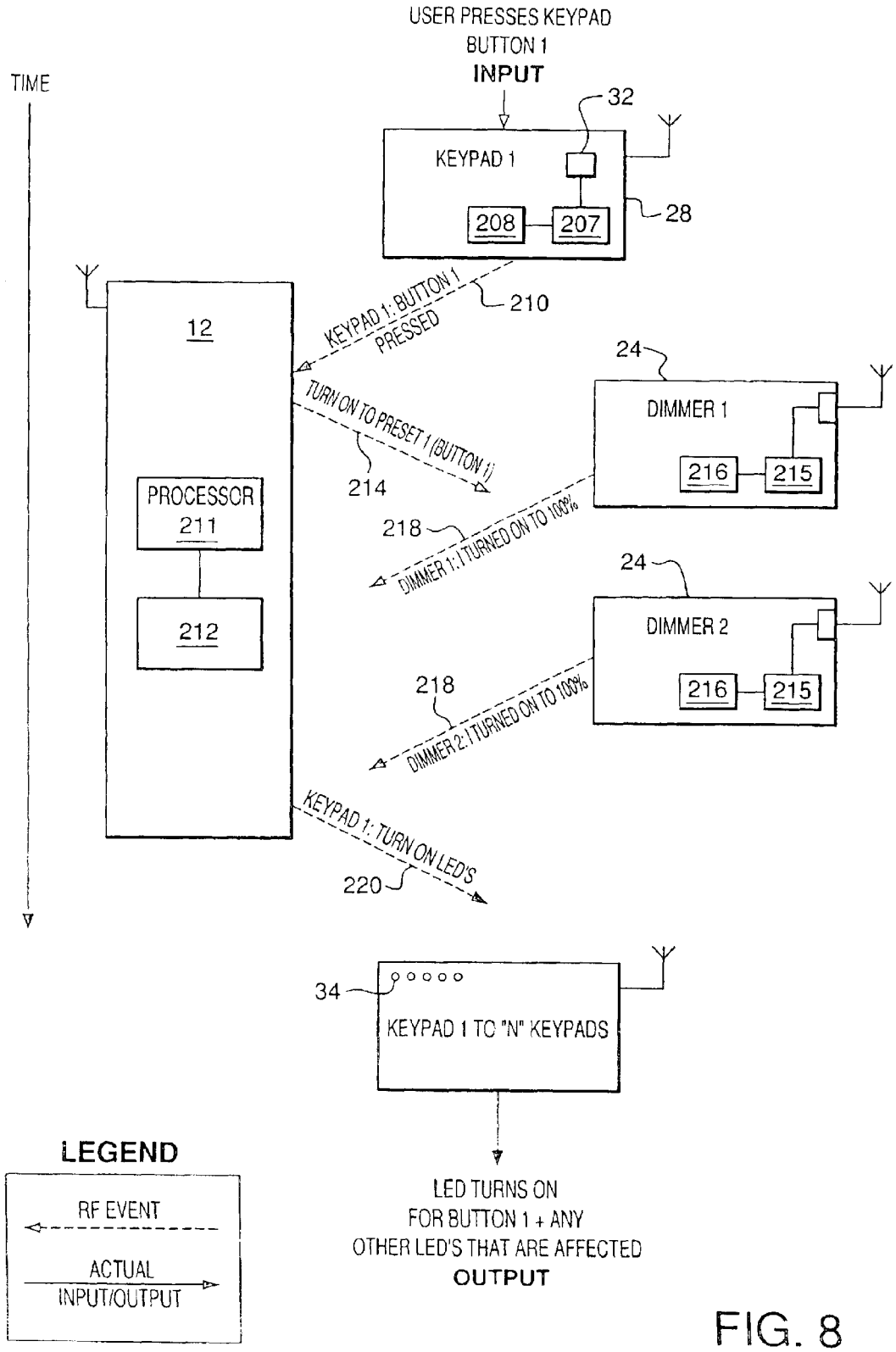
FIGS. 8 to 10 are diagrams of signal interchanges within the lighting control system of FIG. 1.
Figure 9:
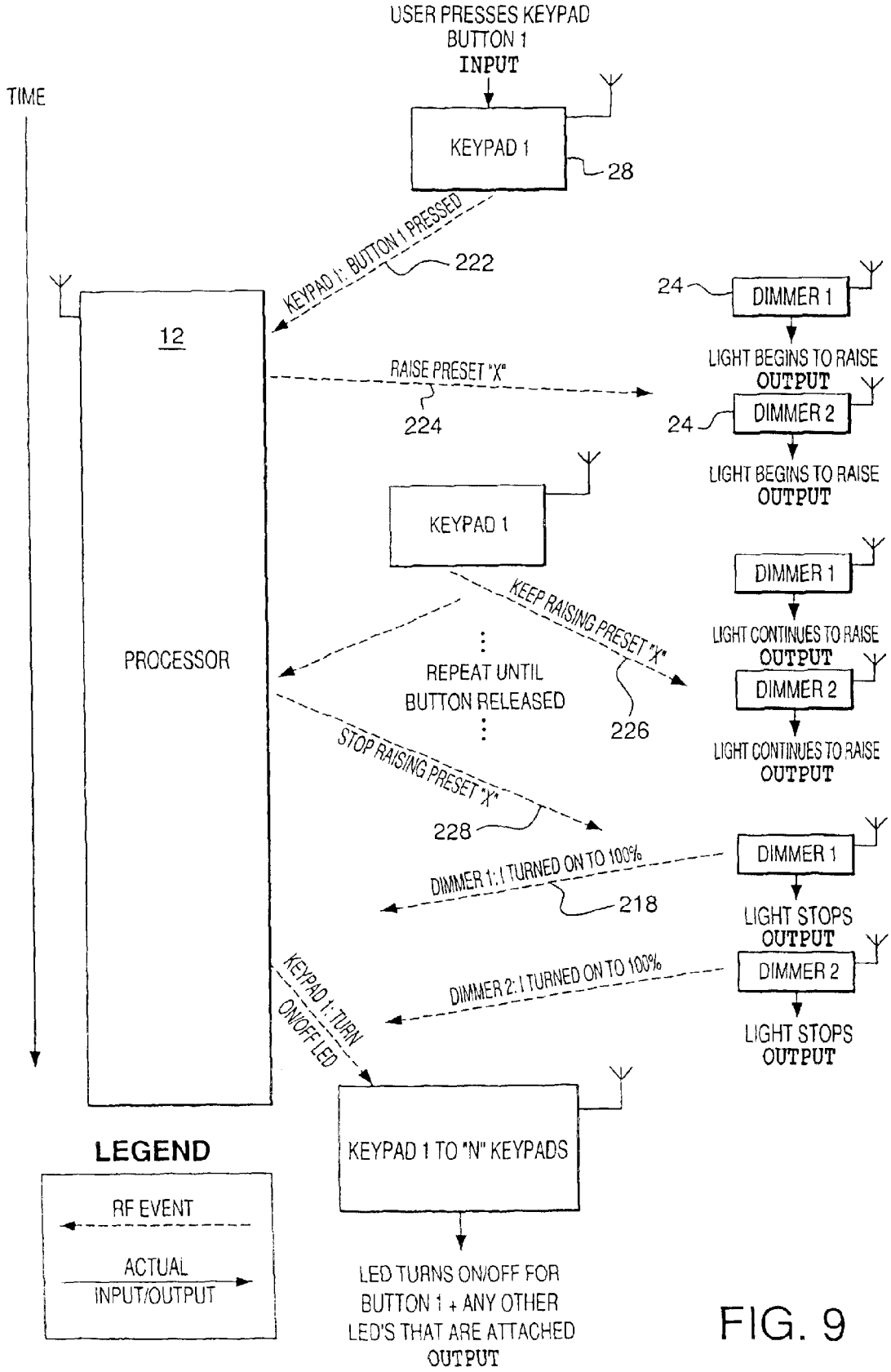

Referring now also to FIGS. 8 and 9, in order to minimize the amount of radio traffic, the databases controlling the system are divided into three parts, held in the event initiators 28, in the device controllers 24, and in the central processor 12.

As discussed above, the database in a keypad or other event initiator gives the keypad 28 enough intelligence to know what to send to the processor 12 in the form of actions by a user of the event initiator, for example, a button press or a release. User actions that do not cause events in the system would waste bandwidth, so should not be transmitted. User actions that do cause events should be transmitted in the most efficient form.

The keypad 28 also knows whether to expect a response back from the processor in the form of an acknowledgment. The acknowledgment can be re-used as, or supplemented by, an update of the keypad's status information to update the display 34. The acknowledgment can also be used to indicate that the keypad 28 should repeat a command because it has not been clearly received, or to send to the keypad 28 a new command that the keypad may not know the definition of.

The dimmers and other device controllers 24 contain lists of scenes. A "preset scene" or "scene" is a pre-programmed setting of one or more device controllers 24, and especially a coordinated setting of several device controllers 24, for example, off, on, and dimmer settings for all of the lights in a room, to produce a coherent effect. For each scene, each device controller 24 knows what level of dimming or other state to set its controlled device 22 to, and may also know what rate of fade and what delay before the fade starts to use when activating that scene. It is then merely necessary to broadcast a single message commanding that a specified scene be activated. The single message can be received, understood, and implemented by every device controller 24 responsible for a device 22 involved in the scene in question. This minimizes the amount of data that needs to be sent to activate a scene, independently of how big the scene is, and independently of how great the changes from the previous state of the controlled devices are. If this is done, the device controllers 24 must, of course, be programmed to accept messages addressed to a "unit address" that indicates a scene command.

Each device controller 24 can also be directly controlled, with signal coding similar to the "button models" described above, so that a device 22 can be set to a status that is not part of a preset scene. After a change, each dimmer or other device controller 24 passes its current level back to the processor 12, so that the processor knows the current state of all dimmers.

The processor 12 does not need to be aware of the actions caused by a button. It can simply run a predetermined script. However, it is preferred that the processor 12 maintain a record of the supposed current status of the entire sub-net. The processor 12 can then verify that the device controllers 24 are reporting the correct status, and that the event initiators 28 and any other display devices are showing the correct status. As mentioned above, this is especially important where a device controller 24 may be controlled by more than one event initiator 28, and where the displays 34 are not necessarily all updated immediately when a change occurs.

In many cases, the processor can simply relay to a device controller 24 the button signals received from an event initiator 28. However, some actions are conditional upon other inputs into the system, such as the time of day. For example, a "scene" may be defined to have different meanings at different times of day, or the response to a command may depend on the existing state of the system. Since the factors involved in these conditional decisions may be numerous and complex, having a central decision point makes for minimal communications. For complex models, the evaluation of what to do on a button press requires a lot of CPU power, and it is therefore economical to have a single, central CPU in the processor 12 that does all of the complex work.

Individual device controllers 24 may also be equipped with local controls 32 that enable the associated device 22 to be controlled directly. When that occurs, the dimmer 24 reports to the processor 12, which updates its own records and determines whether the LEDs in the system are correctly set and transmits any necessary update signals.

Each processor 12 will listen to other processors in the system over the wired link 14 to receive signals that affect devices 22 and displays 34 on its own sub-net. For example, if a single scene involves two groups of lamps 22 that are on different sub-nets, and a button 32 is operated to select that scene, the processor 12 that receives the button press must relay to the other processor 12 the command to select that scene. If a display 34 on one sub-net indicates the status of devices 22 that are on another sub-net, the processor 12 responsible for the devices 22 must update the processor 12 responsible for the display 34. If a portable event initiator 28 is in communication with a sub-net other than its own, then the processor 12 with which the event initiator is in communication must relay messages to and from the event initiator's "home" processor. In order to minimize the amount of data that has to be carried by the links 14 and handled by the processors 12, each processor 12 will only pass information about its part of the system to the links 14 when it changes, and when the changes are relevant to the other sub-nets. This restraint makes very large systems possible without the data capacity of the links 14, or the power of the processors 12, becoming prohibitive.

Since the event caused by pressing a button 32 is usually related to the current state of an LED 34, the processor 12 will usually have the most up to date information about the action that should be performed, and what the LEDs should show, on a button press. Having the action and the LED tied back to the processor 12 keeps things from getting out of synch.

The processor maintains a copy of the dimmer database showing what device 22 each controller 24 controls, and what commands are applicable to that device, so that the information can easily be extracted and changed by features that allow updating of scenes. This also allows for easy integration of third party devices that would communicate with the processors 12 via RS232 ports to receive commands and report their status. The processor can also originate commands to activate scenes or otherwise change the settings of the devices 22. This could happen if the processor is running a pre-programmed sequence, including a "vacation" mode where the processor plays back actual changes in lighting recorded on a previous occasion, or if a time-clock causes a change in lighting to suit a different time of day.

Referring now to FIG. 8, in one example, when a button 32 (in this example, button 1) on an event initiator 28 (in this example, keypad 1) is pressed, a processor 207 in the keypad consults its stored button model 208, which directs it to send a message 210 reporting "button 1 on keypad 1 pressed." On receiving this message, the CPU 211 of the processor 12 consults its dimmer database 212 which, in the present status of the system, identifies a press of keypad 1 button 1 as a command to switch on preset scene 1. The processor 12 therefore sends out a command 214 to turn on to preset scene 1. A processor 215 in each dimmer 24 that receives the command 214 looks it up in its own internal dimmer map 216, and converts the command into instructions to delay for a specific period, then change at a specific fade rate to a specific dimming level. Each dimmer 24 executes these instructions.

Each dimmer 24, after completing the change, sends back a report 218 to the central processor 12. The reports 218 convey information such as "dimmer 1 now at 100% of full brightness." The reports 218 give absolute values, rather than merely acknowledging "command to switch to preset scene 1 received and implemented." The processor 12 can then refer the reports back to its database 212, and verify that for preset scene 1, dimmer 1 at 100% is correct. Thus, any discrepancy between the dimmer maps 216 and the processor's master database 212 can be detected. Once preset scene 1 has been implemented, the processor 12 determines what should be shown on each display 34 for preset scene 1, and sends out to the event initiators 28 instructions 220 on what their displays should show. These instructions may be direct, in the form "keypad 1, turn on all your LEDs" or indirect, such as "all displays show what your local map 208 specifies for preset scene 1." The keypads 28 then update themselves as described in steps 198 to 202 above.

Referring to FIG. 9, in another example, pressing and holding button 1 on keypad 1 is intended to gradually brighten the lamps 22 involved in preset scene X. When the button is pressed, keypad 1 sends a "button pressed" message 222 to the processor 12. As explained above, the keypad may then send a continuous stream of "button still pressed" messages that stops when the button is released, or it may send a single "button released" message when the button is released. When the processor 12 receives the "keypad 1, button 1 pressed" message 222, it sends out a "raise dimming level" message 224 to all dimmers 24 involved in preset X. This can be a message explicitly addressed to "all dimmers involved in preset X," provided that the dimmers in question are programmed to recognize such a message, or it can address the dimmers individually. The command may invoke a "raise model" stored in the dimmer maps 216 (FIG. 8) that specifies how fast each dimmer is to change its level. As long as the button remains pressed, the processor 12 can send out a continuous stream of "continue raising" commands 226. Instead, it can send out an initial "start raising" command and a final "stop raising" command 228. The dimmers 24 act on these commands 224–228 as they are received. When the "continue raising" commands cease or the "stop raising command 228 is received, each dimmer 24 stops changing its dimming level, and sends a report 218 of its final position. The central processor 12 updates its database 212 (FIG. 8) to show the current level of each dimmer 24. The actual figures reported by the dimmers are to be preferred to the levels predicted by the central processor, though any major discrepancies in the final levels may be diagnostic of discrepancies between the databases or problems in the system.

Figure 10:
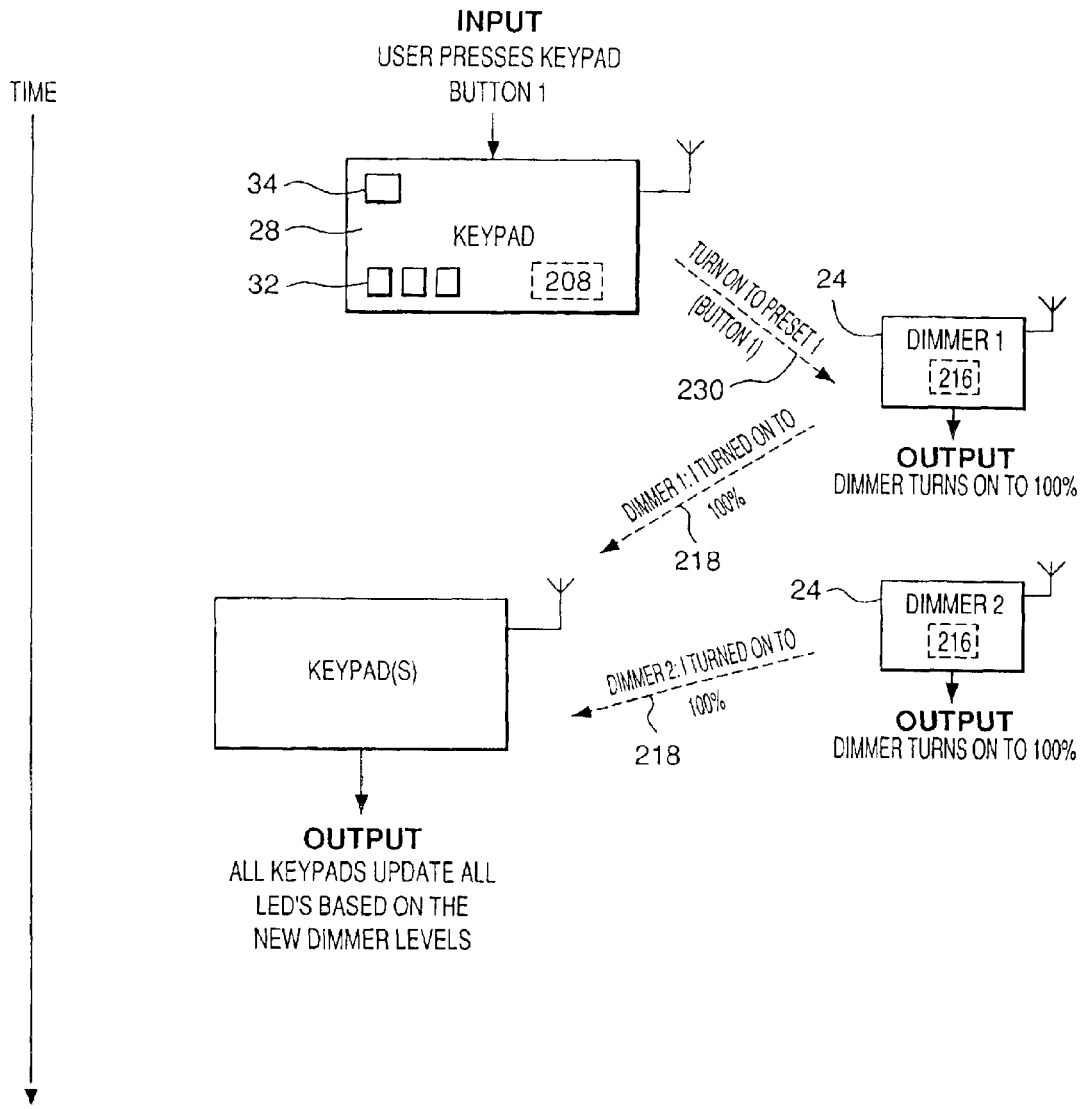
Figure 10:
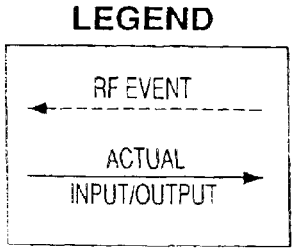

Referring now to FIG. 10, under some circumstances, the central processor 12 may be omitted. The processor could be entirely absent in a very simple system, or one or more individual event initiators 28 could be configured to control one or more individual device controllers 24 directly, with the central processor 12 merely monitoring and recording what happens. In this case, the databases within the system are divided into two parts, one in the device controller and one in the event initiator, to minimize message traffic and therefore to minimize required system bandwidth.

The input devices (event initiators 28) then have button configuration information describing how to compute the LED status, because they cannot rely on status updates from the processor 12. The button model map in the event initiators 28 must use exactly the same commands as the device model map in the device controllers 22, because there is no central processor to convert commands from one form to the other. If a master map of the status of the controlled devices is maintained, it will usually be distributed among the event initiators 28. If one event initiator 28 controls more than one device controller 24, it may also have a "Button/Preset" map and a map describing which devices are affected when a button is pressed and/or a preset command is sent out.

The button/preset map tells the keypad 28 which group of dimmers 24 should acknowledge the command sent out when a button is pressed. As with the preset scene command described above, rather than sending a command to each dimmer that is affected, one preset command is sent to all of them. This conserves RF bandwidth and gives faster system response. However, if no processor 12 is involved, the preset command must be generated within the event initiator 28. A preset command is a unique identifier for a scene. If the command as broadcast includes an event initiator address, only the combination of address and command may be unique. In that case, different keypads can be allowed to transmit identical commands in response to identical operations of their controls 32, even if those operations have different meanings, provided that the dimmers 24 are programmed to distinguish the commands from different keypads. Instead, the command alone may be unique. The event initiator address then at most serves for verification that the preset command was issued by a keypad that exists and should be able to issue that command.

When operating dimmers with a Preset command, the keypad does not have to know anything regarding fade rates or delay times, which can be programmed into the dimmers 24. The event initiator 28 preferably knows which device controllers 24 respond to each Preset command, for verification purposes to be explained below.

The output devices (dimmers or device controllers 24) have a "Preset/Level" map describing the levels to turn on to, how long to delay before reacting, and how slowly to fade to their goal level for each Preset. The output devices need not know which other output devices are affected by the same Preset command.

After reacting to a Preset command, each affected output device 24 acknowledges that it received the Preset command. If the acknowledgment returns the actual final setting of the output device, then the originating event initiator must know the correct final settings for the command that it has issued. In any event, every device that has a display must be able to recognize exchanges between another keypad and one or more output devices that may require that display to be updated. If an originating device does not hear back from all of the output devices that should have been affected, it will generate an automatic reactivation and send the Preset command again.

Referring to FIG. 10, in one example, a user presses button 1 on keypad 1. Keypad 1 consults its dimmer database 208 which, in the present status of the system, identifies a press of keypad 1 button 1 as a command to switch on preset scene 1. Keypad 1 issues a "switch to Preset Scene 1" command 230, directly to the dimmers 24. Each dimmer 24 that receives the command 230 looks it up in its own internal dimmer map 216, and converts the command into instructions to delay for a specific period, then change at a specific fade rate to a specific dimming level. Each dimmer 24 executes these instructions.

Each dimmer 24, after completing the change, sends back a report 218. The reports 218 convey information such as "dimmer 1 now at 100% of full brightness." The reports 218 give absolute values, rather than merely acknowledging "command to switch to preset scene 1 received and implemented." The keypad 28 can then refer the reports back to its database 208, and verify that for preset scene 1, dimmer 1 at 100% is correct. Thus, any discrepancy between the dimmer maps 216 and the keypad preset maps 208 can be detected. Once preset scene 1 has been implemented, the keypad 28 determines what should be shown on its display 34 for preset scene 1, and updates itself as described in steps 198 to 202 above. Any other devices in the system that have displays 34 monitor the dimmer reports 218, and determine whether those affect the information shown on their own displays. Those devices then update their displays as necessary. This requires each device with a display 34 to have a detailed map of which output devices 24 its display relates to, and how they interrelate.

Databases in the input and output devices can be created in two ways: by means of a programmer (PC, GUI, etc.) using the radio link to command each unit in turn; or "manually" by walking around to each Keypad, Device, etc. and programming it locally.

Device databases and operating system updates may be downloaded to the devices over the same wireless link as is used for normal operation.

Figure 11:
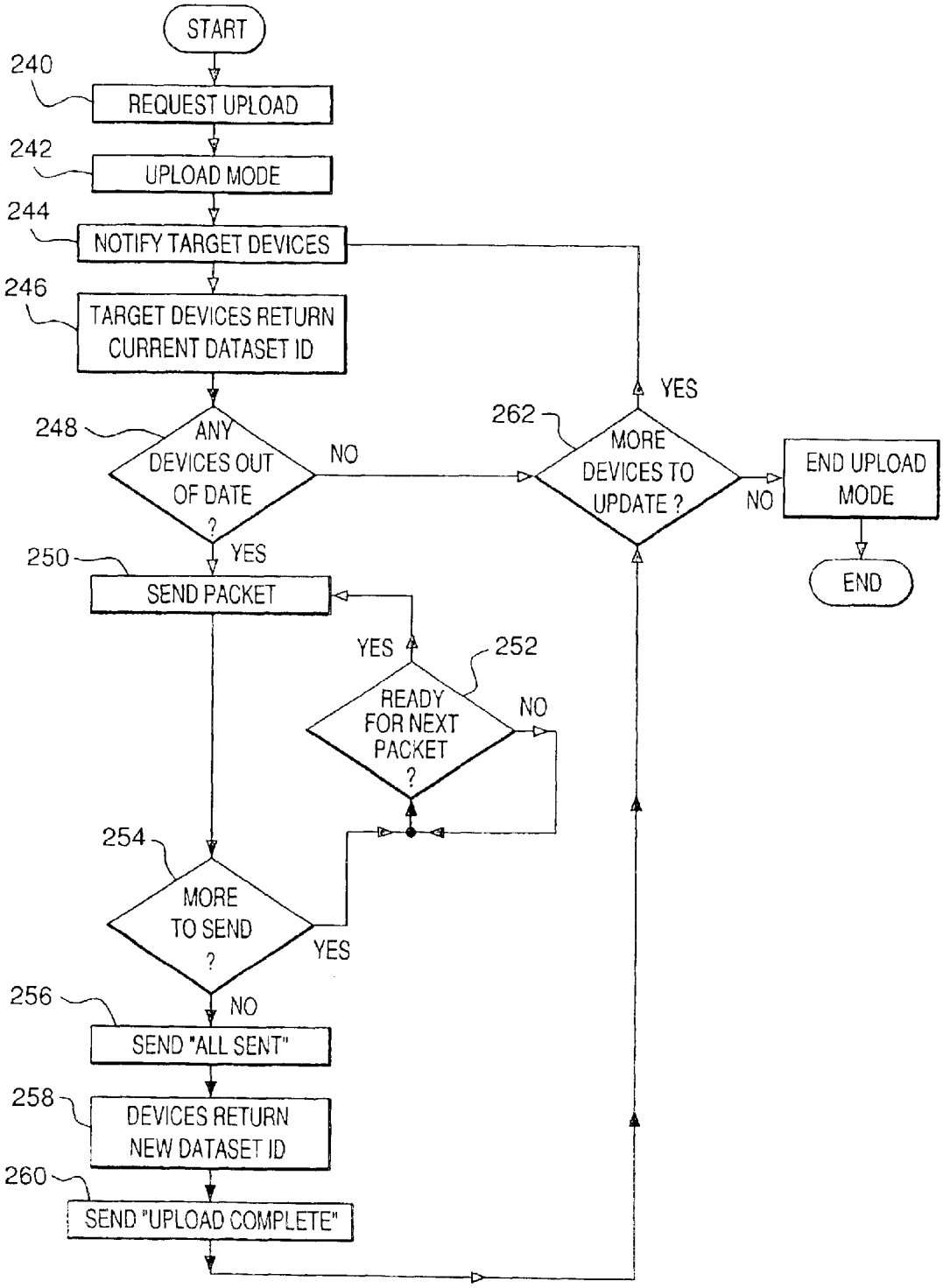
FIG. 11 is a flowchart illustrating a method of uploading an operating system and a database in a lighting control system of the invention.

Referring now to FIG. 11, in step 240 a user, a host computer supplying the update, or a system device requests a Database or OS upload. The uploaded data is stored in the memory 208 or 216 on each event initiator, repeater, or device controller.

In step 242, the central processor announces Upload Mode to all devices on the channel. While Upload Mode is in effect, the central processor has exclusive control of the wireless channel, and all devices know that they are not to transmit except in response to messages from the central processor relating to the upload process. It would be possible to upload new datasets without taking exclusive control of the wireless channel. However, the risk of packets of data being delayed, lost or corrupted because of conflicting traffic may be significant, depending on the communications protocol used. This is especially important during an OS Upload, because it is assumed that the newly uploaded data packets will immediately overwrite the previous dataset, so a device in the middle of an OS Upload may not have proper functionality.

In step 244, the central processor notifies specific devices that are due to be receiving data. In step 246, those devices send back a Data ID code for their current dataset. In step 248, the central processor compares the received Data ID codes with the Data ID code for the new dataset, to determine whether the devices already have the current data. For an OS upload, the Data ID code is an OS revision number.

If any device has a dataset that is not current, a Data transfer will begin in step 250, when the central processor sends out a packet of data to the relevant device(s). An operating system upload can be sent at one time to all units using the same operating system or the same subset of the operating system. In a typical system, many of the units will be multiple units of common types that share the same operating system. Sending to all of those units at once can thus be a great saving in volume of data transmitted. The databases used by individual devices are more likely to be subsets of the overall database that are all different, so with a database upload it is more likely to be efficient for the central processor to generate database subsets to be uploaded to individual units. In step 252, the Device(s) respond when they are ready for more. For an OS upload, the processor queries the devices to determine when they are ready for more data. In step 254, the central processor determines whether all data has been sent, and repeats steps 250 and 252 as necessary.

In step 256, the processor 12 tells the devices that all of the data has been sent. In step 258, the devices determine the Data ID for the newly-received dataset and send it to the central processor 12. This is prompted by a query from the central processor 12, if doing an OS Upload. In step 260, if the new Data ID is correct, and the upload was an OS Upload, the central processor 12 tells the device(s) that the Upload is complete and that they should start running the new OS. In step 262, the central processor 12 checks whether there are more devices to update with another dataset. If so, the process loops back to step 244 and repeats for the new dataset. Because most devices in the system have only a small subset of the overall database, and different devices may have differently optimized operating systems, or different subsets of the operating system, a major update of a large system may require several upload sessions.

Once all of the uploads are complete, in step 264 the central processor 12 tells all devices on the link to exit Upload Mode. This allows all devices to claim the link for ordinary operating messages when necessary. If less than the whole system was in an Upload Mode that excluded normal access to the communications links, the status data in event initiators, displays, and the like should be updated to reflect any system events that the unit in question missed because of the upload.

Although the invention has been described with reference to specific embodiments thereof, it will be understood that various changes may be made thereto without departing from the scope and spirit of the invention. For example, although reference has been made to radio communications, many aspects of the present invention are applicable to other parts of the electromagnetic spectrum, to broadcast media other than electromagnetic radiation, and to other means of communication, including wired networks.

What is claimed is:

1. A lighting control system comprising event initiators having controls operable by a user, devices controlled by said event initiators, and a central processor, wherein:

said event initiators and controlled devices comprise parts of a system database;

said database part within each event initiator maps operations of controls by a user to commands transmissible from such event initiator to said controlled devices;

said database part within each controlled device maps commands received from an event initiator to actions of such device;

said transmissible commands contain less data than is necessary to describe completely the operations of controls or the actions of devices;

said event initiators are arranged to transmit to said central processor sufficient information to identify an operation of said controls by a user that validly commands the system, and said central processor is arranged to transmit commands to said controlled devices.

2. A system according to claim 1, wherein said controlled devices are programmed with preset states, and said transmissible commands comprise at least one command that commands at least one said controlled device to enter such a preset state.

3. A system according to claim 2, wherein said controlled devices are programmed with processes for entering said preset states, and no separate command to invoke said processes is transmitted.

4. A system according to claim 2, wherein at least some of said controlled devices are controllable over a range of operating values, and said preset states include specified operating values within such ranges.

5. A system according to claim 1, wherein said commands are transmitted on a shared wireless communications path.

6. A system according to claim 1, wherein said shared communications path is a radio channel.

7. A system according to claim 1, wherein said event initiators and controlled devices are each provided with an input device by means of which an operator can update said database parts.

8. A system according to claim 1, wherein said event initiators and controlled devices are arranged to receive updates to said database parts over the same medium through which said commands are transmitted.

9. A system according to claim 1, wherein each controlled device after taking action in response to a said command transmits a response indicative of an event occurring at said controlled device resulting from the action.

10. A system according to claim 9, wherein said response is indicative of a state of said controlled device resulting from said action.

11. A system according to claim 9, wherein the event initiator from which the command in question originated, on receiving the response transmitted by the said controlled device, maps the state of the said controlled device to the user control operation from which the command was mapped, and provides an indication if the control operation was correctly executed.

12. A system according to claim 9, wherein each event initiator comprises a display, and wherein each said event initiator is adapted, in response to operation of at least one said control, to:

predict whether said operation of said at least one control will result in a change of state of said display;

update said display if the predicted state of said display differs from the state of said display before said operation of at least one control;

transmit a said command indicative of said operation of said at least one control;

receive said response indicative of said event that actually occurs in response to said transmitted command; and update said display if a state of said display correct in view of said response differs from the state of said display as updated on the basis of said prediction.

13. A system according to claim 12 that is arranged to emit a signal if said display is updated more than a predetermined time after detecting said operation of said at least one control.

14. A system according to claim 12, that is arranged to update said display in response to other instructions received.

15. A lighting control system comprising event initiators having controls operable by a user and devices controlled by said event initiators, wherein:

said event initiators and controlled devices comprise parts of a system database;

said database part within each event initiator maps operations of controls by a user to commands transmissible from such event initiator to said controlled devices;

said database part within each controlled device maps commands received from an event initiator to actions of such device;

said transmissible commands contain less data than is necessary to describe completely the operations of controls or the actions of devices; and each controlled device after taking action in response to a said command transmits a response indicative of an event occurring at said controlled device resulting from the action.

16. A system according to claim 15, wherein said response is indicative of a state of said controlled device resulting from said action.

17. A system according to claim 15, wherein the event initiator from which the command in question originated, on receiving the response transmitted by the said controlled device, maps the state of the said controlled device to the user control operation from which the command was mapped, and provides an indication if the control operation was correctly executed.

18. A system according to claim 15, wherein each event initiator comprises a display, and wherein each said event initiator is adapted, in response to operation of at least one said control, to:

predict whether said operation of said at least one control will result in a change of state of said display;

update said display if the predicted state of said display differs from the state of said display before said operation of at least one control;

transmit a said command indicative of said operation of said at least one control;

receive said response indicative of said event that actually occurs in response to said transmitted command; and update said display if a state of said display correct in view of said response differs from the state of said display as updated on the basis of said prediction.

19. A system according to claim 18 that is arranged to emit a signal if said display is updated more than a predetermined time after detecting said operation of said at least one control.

20. A system according to claim 18 that is arranged to update said display in response to other instructions received.

21. A lighting control system comprising an event initiator having a control operable by a user, a central processor, and a device controlled by said event initiator, wherein:

said event initiator and said controlled device comprise parts of a system database;

said database part within said event initiator maps an operation of said control by a user to a first command transmissible from said event initiator;

said event initiator is arranged to transmit to said central processor sufficient information to identify said operation of said control that validly commands the system;

said central processor is arranged to transmit a second command to said controlled device;

said database part within said controlled device maps said second command received from said event initiator to an action of said device;

said first and second commands contain less data than is necessary to describe completely said operation of said control or said action of said device.

22. A system according to claim 21, wherein said controlled device is programmed with a preset state, and said second command commands said controlled device to enter said preset state.

23. A system according to claim 22, wherein said controlled device is programmed with a process for entering said preset state, and no separate command to invoke said process is transmitted.

24. A system according to claim 22, wherein said controlled device is controllable over a range of operating values, and said preset state includes a specified operating value within said range.

25. A system according to claim 21, wherein said first and second commands are transmitted on a shared wireless communications path.

26. A system according to claim 21, wherein said shared communications path is a radio channel.

27. A system according to claim 21, wherein said event initiator and said controlled device are each provided with an input device by means of which an operator can update said database parts.

28. A system according to claim 21, wherein said event initiator and said controlled device are arranged to receive updates to said database parts over the same medium through which said first and second commands are transmitted.

29. A system according to claim 21, wherein said controlled device after taking said action in response to said second command transmits a response indicative of an event occurring at said controlled device resulting from said action.

30. A system according to claim 29, wherein said response is indicative of a state of said controlled device resulting from said action.

31. A system according to claim 29, wherein said event initiator, on receiving said response transmitted by said controlled device, maps the state of said controlled device to said operation of said control from which said first command was mapped, and provides an indication if said operation of said control was correctly executed.

32. A system according to claim 29, wherein said event initiator comprises a display, and wherein said event initiator is adapted, in response to said operation said control, to:

predict whether said operation of said control will result in a change of state of said display;

update said display if the predicted state of said display differs from the state of said display before said operation of said control;

transmit said command indicative of said operation of said control;

receive said response indicative of said event that actually occurs in response to said command; and update said display if a state of said display correct in view of said response differs from the state of said display as updated on the basis of said prediction.

33. A system according to claim 32 that is arranged to emit a signal if said display is updated more than a predetermined time after detecting said operation of said control.

34. A system according to claim 32 that is arranged to update said display in response to other instructions received.

35. A lighting control system comprising an event initiator having a control operable by a user and a device controlled by said event initiator, wherein:

said event initiator and said controlled device comprise parts of a system database;

said database part within said event initiator maps an operation of said control by a user to a command transmissible from said event initiator to said controlled device;

said database part within said controlled device maps said command received from said event initiator to an action of said device;

said command contains less data than is necessary to describe completely said operation of said control or said action of said device; and said controlled device after taking said action in response to said command transmits a response indicative of an event occurring at said controlled device resulting from said action.

36. A system according to claim 35, wherein said response is indicative of a state of said controlled device resulting from said action.

37. A system according to claim 35, wherein the event initiator, on receiving said response transmitted by the said controlled device, maps the state of said controlled device to said operation of said control from which said command was mapped, and provides an indication if said operation of said control was correctly executed.

38. A system according to claim 35, wherein said event initiator comprises a display, and wherein said event initiator is adapted, in response to said operation said control, to:

predict whether said operation of said control will result in a change of state of said display;

update said display if the predicted state of said display differs from the state of said display before said operation of said control;

transmit said command indicative of said operation of said control;

receive a response indicative of an event that actually occurs in response to said command; and update said display if a state of said display correct in view of said response differs from the state of said display as updated on the basis of said prediction.

39. A system according to claim 38 that is arranged to emit a signal if said display is updated more than a predetermined time after detecting said operation of said control.

40. A system according to claim 38 that is arranged to update said display in response to other instructions received.

* * * * *